US007152531B2

(12) United States Patent
Miyoshi

(10) Patent No.: US 7,152,531 B2
(45) Date of Patent: Dec. 26, 2006

(54) INTERLEAF REMOVAL APPARATUS, PLATE FEED APPARATUS AND IMAGE RECORDING SYSTEM

(75) Inventor: Hiroshi Miyoshi, Kyoto (JP)

(73) Assignee: Dainippon Screen Mfg. Co. Ltd., Kyoto (JP)

( * ) Notice: Subject to any disclaimer, the term of this patent is extended or adjusted under 35 U.S.C. 154(b) by 133 days.

(21) Appl. No.: 11/087,668

(22) Filed: Mar. 24, 2005

(65) Prior Publication Data

US 2005/0217524 A1 Oct. 6, 2005

(30) Foreign Application Priority Data

Mar. 31, 2004 (JP) ..... 2004-102472

(51) Int. Cl.
*B65H 3/08* (2006.01)

(52) U.S. Cl. ..... 101/477; 101/480; 271/91; 271/92; 414/797

(58) Field of Classification Search ..... 101/477, 101/479, 480; 271/90, 91, 92, 105, 106, 271/107; 414/416.07, 752.1, 797
See application file for complete search history.

(56) References Cited

U.S. PATENT DOCUMENTS 7,044,056 B1 * 5/2006 Miyoshi ..... 101/477
2003/0231947 A1 12/2003 Miyoshi

FOREIGN PATENT DOCUMENTS

JP 11-208909 8/1999
JP 2004-18180 A 1/2004

* cited by examiner

*Primary Examiner*—Leslie J. Evanisko
(74) *Attorney, Agent, or Firm*—McDermott Will & Emery LLP

(57) ABSTRACT

An interleaf at the top position of a stack of plates and interleaves stored in a cassette is removed by attaching the interleaf to suction pads mounted to a vertically movable support. When the interleaf in the cassette is moved upwardly to a position opposed to a pair of nip rollers, movable suction pads move horizontally in such a direction as to stretch the interleaf to remove wrinkles in the interleaf. Then, a leading edge portion of the interleaf is held between the pair of nip rollers and removed outwardly.

12 Claims, 18 Drawing Sheets

INTERLEAF REMOVAL APPARATUS, PLATE FEED APPARATUS AND IMAGE RECORDING SYSTEM

BACKGROUND OF THE INVENTION

1. Field of the Invention

The present invention relates to an interleaf removal apparatus for removing interleaves (also referred to as slip sheets) each between a plurality of plates for protection of the surfaces of the plates out of a storage part in which these plates are stored in a stacked relationship, in a plate feed apparatus for an image recording system for recording an image on a plate.

2. Description of the Background Art

A plate feed apparatus automatically feeds a plate to an image recorder and the like for recording an image on the plate by directing an optical beam such as laser light onto the plate. An interleaf removal apparatus is used in such a plate feed apparatus.

A plurality of plates and a plurality of interleaves are alternately vertically stacked in a cassette in the plate feed apparatus.

The interleaf removal apparatus removes an interleaf underlying a plate outwardly from the plate feed apparatus each time the plate is taken out of the cassette by means of a movable arm or the like.

Unfortunately, an interleaf often clings to a plate because of static electricity and the like. In such a case, there arises a need for a mechanism for peeling the interleaf desired to be taken out away from the plate.

For example, Japanese Patent Application Laid-Open No. 2004-18180 discloses an apparatus provided with a mechanism for horizontally moving suction pads when lifting an interleaf by means of the suction pads, thereby to give vibrations to the interleaf being lifted. This apparatus can drop the plate and the like clinging to the back surface of the interleaf by the use of the vibrations.

In the case of the apparatus disclosed in Japanese Patent Application Laid-Open No. 2004-18180 as an example, interleaves in a wrinkle-free condition are typically stored in a cassette. Thus, a leading edge portion of the interleaf lifted by the suction pads is fed in a substantially horizontal position outwardly from the apparatus. In some rare cases, an interleaf stored in the cassette is wrinkled or is not placed in a proper position. For example, a plate being taken out of the cassette drags an interleaf underlying the plate to consequently cause wrinkles in the interleaf.

Wrinkles in the interleaf might result in a danger that a paper jam occurs when the interleaf taken out is removed outwardly from the interleaf removal apparatus.

SUMMARY OF THE INVENTION

The present invention is intended for an interleaf removal apparatus provided in a plate feed apparatus constituting an image recording system for recording an image on a plate, the interleaf removal apparatus removing an interleaf from a storage part of the plate feed apparatus.

According to the present invention, the interleaf removal apparatus for removing an interleaf from a stack of alternating plates and interleaves comprises: (a) a plurality of suction cups for holding and fixing an interleaf under suction; (b) a support for supporting the plurality of suction cups; (c) a lifting element for vertically moving the plurality of suction cups together with the support with respect to the stack; (d) a suction element for causing the plurality of suction cups to exert suction; (e) a suction cup moving element for moving at least one of the plurality of suction cups toward and away from the remainder of the plurality of suction cups; and (f) a rotatable holding element including a pair of rollers capable of rotating while holding an interleaf therebetween, wherein the lifting element vertically moves the support to locate an interleaf held under suction by the plurality of suction cups in a nearby position close to the rotatable holding element, wherein the suction cup moving element is capable of moving at least one of the plurality of suction cups when the interleaf held under suction is in the nearby position, and wherein the rotatable holding element rotates while holding the interleaf held under suction in a stretched condition in the nearby position to remove the interleaf held under suction outwardly, and the suction element releases the suction when the interleaf held under suction is held by the rotatable holding element.

This reliably removes an interleaf outwardly from the interleaf removal apparatus without the occurrence of a paper jam even if the interleaf stored in the storage part is wrinkled.

Preferably, the rotatable holding element is capable of switching between an open state and a nipping state, and the rotatable holding element is switched from the open state to the nipping state to hold the interleaf held under suction when the interleaf held under suction is in the stretched condition in the nearby position.

This reliably removes an interleaf outwardly from the interleaf removal apparatus without the occurrence of a paper jam even if the interleaf is not rigid.

More preferably, a direction in which the plurality of suction cups move is coincident with a direction of a rotation axis of the rotatable holding element.

Thus, a direction in which wrinkles in the interleaf are removed is coincident with the direction of the rotation axis of the rotatable holding element. This prevents a paper jam in the rotatable holding element more effectively.

It is therefore an object of the present invention to provide a technique capable of satisfactorily removing an interleaf placed between plates if the interleaf is wrinkled.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
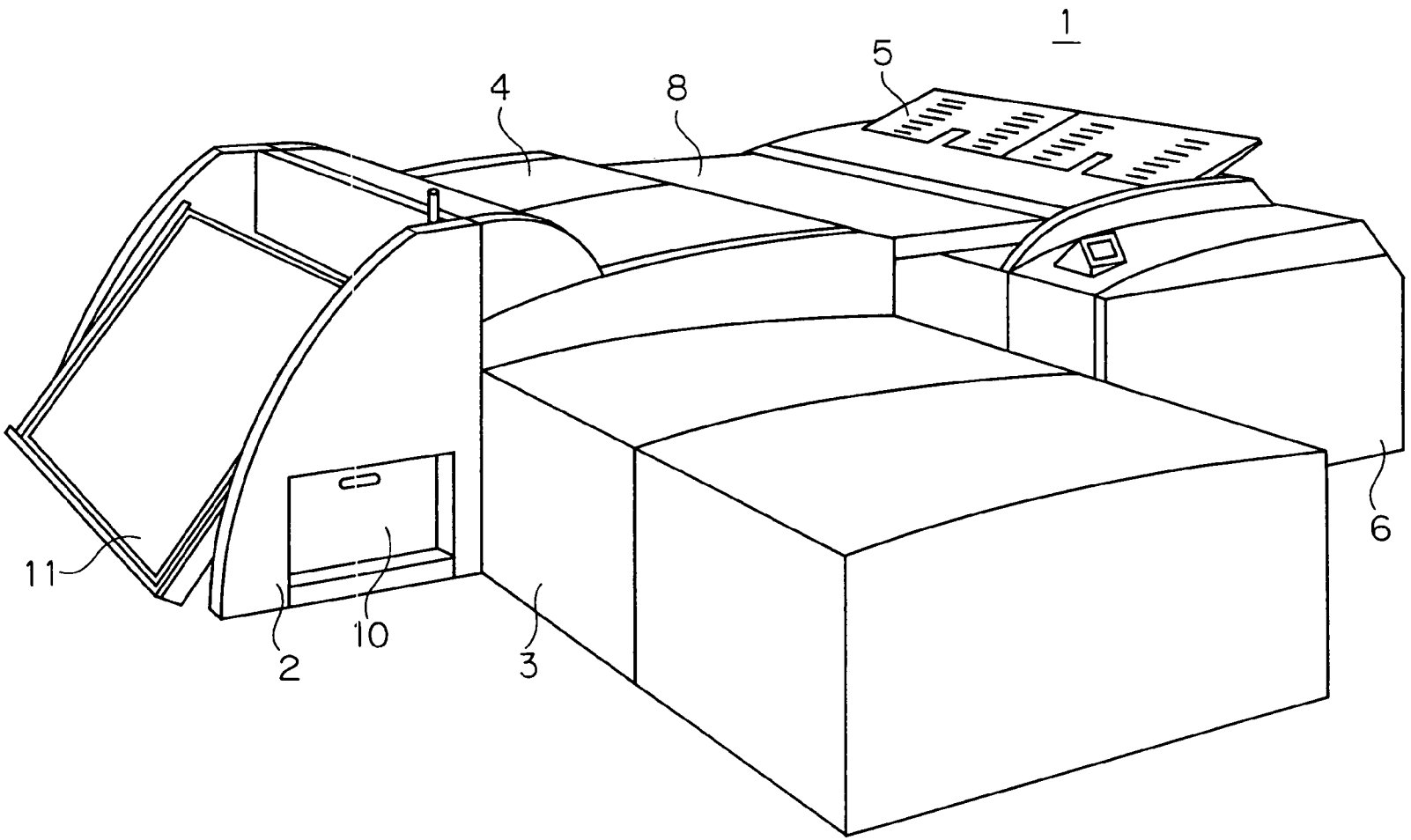
FIG. 1 is a perspective view of an image recording system including an interleaf removal mechanism according to the present invention.
Figure 2:
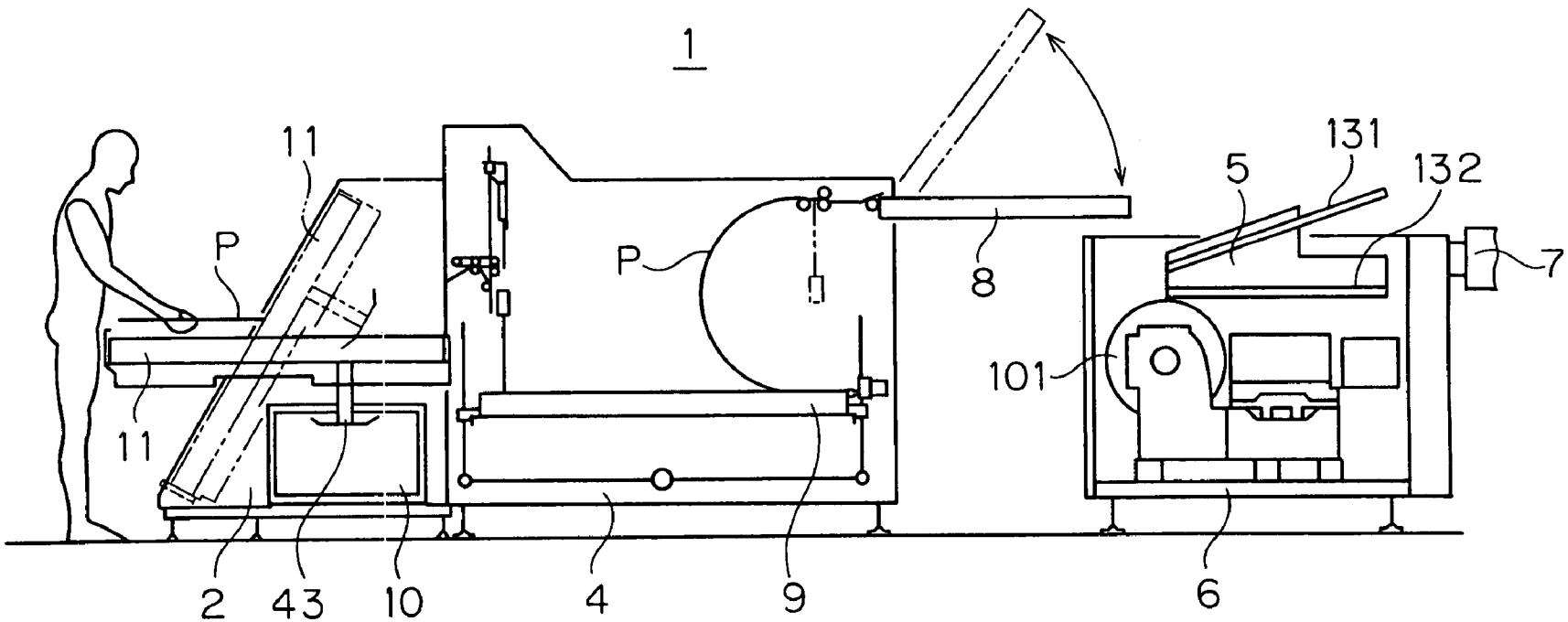
FIG. 2 is a schematic side view of the image recording system including the interleaf removal mechanism according to the present invention.
Figure 3:
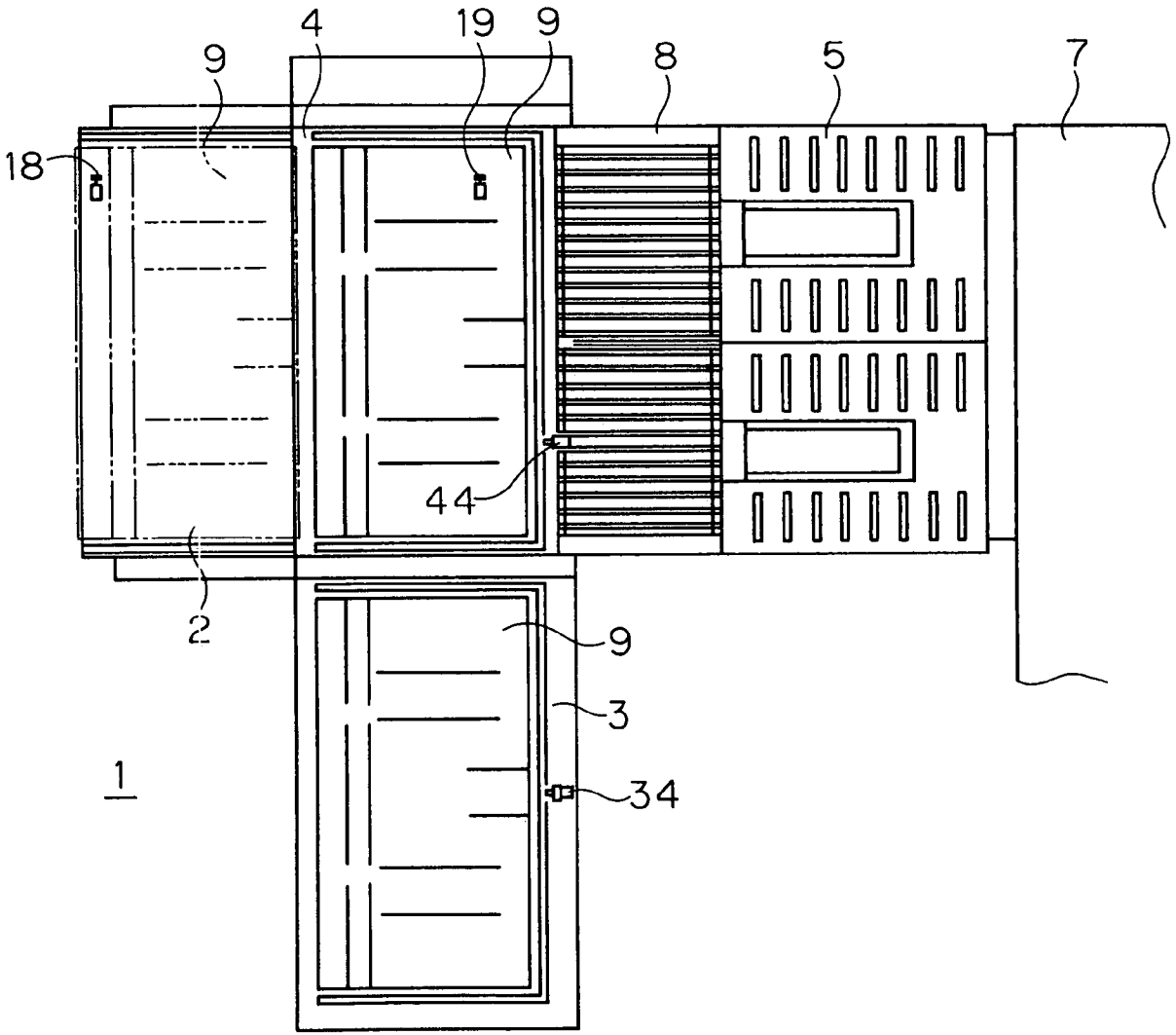
FIG. 3 is a schematic plan view of the image recording system including the interleaf removal mechanism according to the present invention.

A preferred embodiment according to the present invention will now be described with reference to the drawings. FIG. 1 is a perspective view of an image recording system 1 including a plate feed apparatus according to the present invention. FIG. 2 is a schematic side view of the image recording system 1, and FIG. 3 is a schematic plan view thereof.

(Image Recording System)

The image recording system 1 comprises a plate storage part 2, a multi-cassette part 3, an autoloader part 4, a feed/discharge tray part 5, an image recording part 6, a transfer mechanism 7, and a conveyor part 8. The plate storage part 2 is used when storing plates P in a cassette 9. The multi-cassette part 3 holds a plurality of cassettes 9 arranged vertically in multiple tiers. The autoloader part 4 acts to remove a plate P out of a cassette 9 in a predetermined plate feed position. The feed/discharge tray part 5 has a plate feed tray 131 and a plate discharge tray 132, and is provided to transfer the plate P to and from the image recording part 6. The image recording part 6 acts to record a predetermined image on the plate P. The transfer mechanism 7 is provided to transfer the plate P on which the image is recorded by the image recording part 6 to an automatic developing apparatus in a subsequent stage. The conveyor part 8 is intended to transport the plate P from the autoloader part 4 to the feed/discharge tray part 5. The conveyor part 8 is pivotable in flip-up fashion about one edge thereof as indicated by the dash-double-dot lines in FIG. 2 for improvement in maintenance of the entire apparatus.

In the image recording system 1, the multi-cassette part 3 can store therein five cassettes 9 arranged vertically in tiers. For transport of a plate P in a cassette 9 to the image recording part 6, a slide mechanism to be described later moves the cassette 9 stored in the multi-cassette part 3 to the autoloader part 4. Then, a lifting mechanism to be described later vertically moves the cassette 9 to a plate feed position shown in FIG. 2.

For storage of a new plate P into a cassette 9, the slide mechanism to be described later first moves the cassette 9 stored in the multi-cassette part 3 to the autoloader part 4. Then, the lifting mechanism to be described later vertically moves the cassette 9 to a cassette take-out position level with a cassette receiver 11 in a horizontal position indicated by the solid lines in FIG. 2. Thereafter, the cassette 9 in the autoloader part 4 is driven by motors 18 and 19 shown in FIG. 3 to move along a guide member not shown into the cassette receiver 11 in the plate storage part 2.

(Cassette Receiver)

Figure 4:
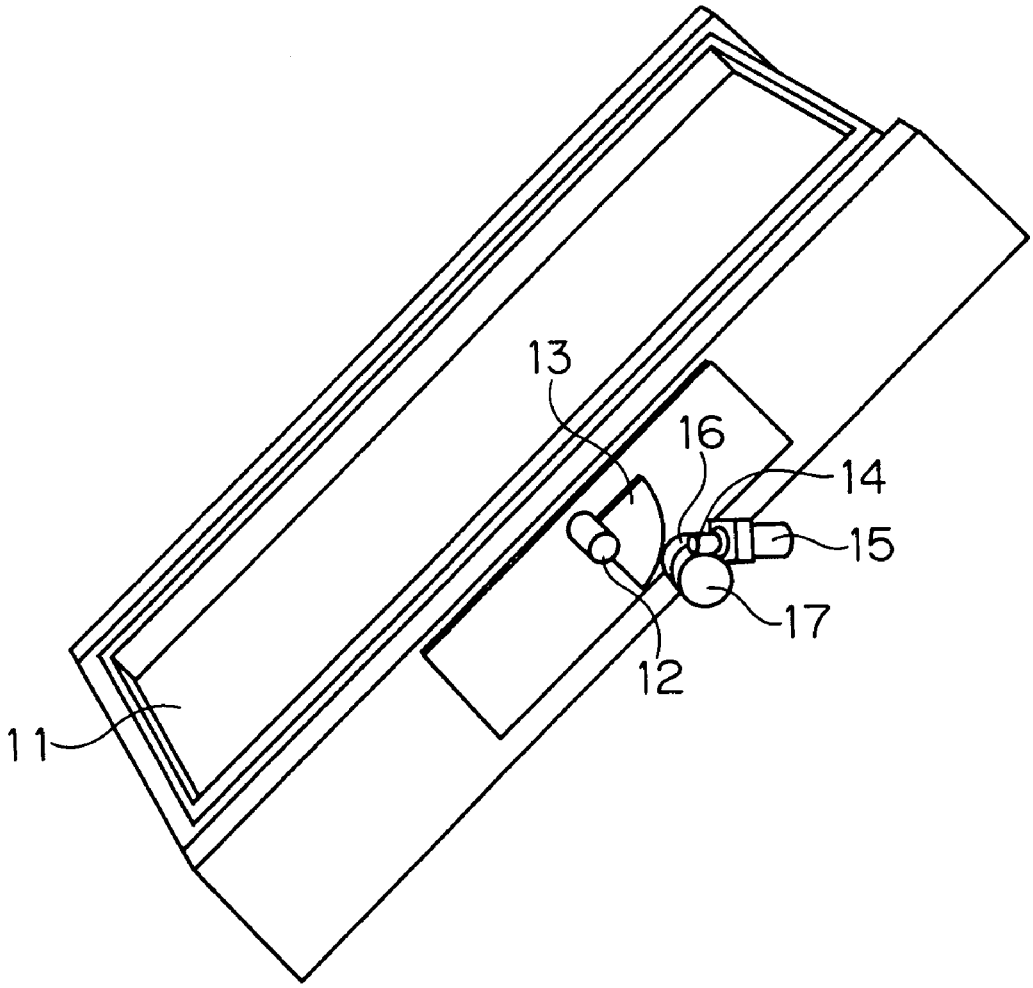
FIG. 4 is a perspective view of a pivotal mechanism in a cassette receiver.

FIG. 4 is a perspective view of a pivotal mechanism in the cassette receiver 11. The cassette receiver 11 includes a shaft 12, and is provided in the plate storage part 2 for pivotal movement about the shaft 12. A spur gear 13 whose central axis is the shaft 12 is provided on the outer periphery of the shaft 12. A motor 15 provided with a worm gear 14 is disposed in the plate storage part 2. The worm gear 14 is in meshing engagement with a worm wheel 17 coaxial with a spur gear 16 in meshing engagement with the spur gear 13. Thus, the cassette receiver 11 is driven by the motor 15 to pivot between the horizontal position indicated by the solid lines in FIG. 2 and an inclined position indicated in phantom in FIG. 2. During the movement of the cassette 9 between the autoloader part 4 and the cassette receiver 11, the cassette receiver 11 assumes the horizontal position. For storage of the plate P into the cassette 9 moved in the cassette receiver 11, the cassette receiver 11 may remain assuming the horizontal position if the plate P is relatively small. For storage of the plate P which is relatively large into the cassette 9, the cassette receiver 11 assumes the inclined position. This allows the relatively large plate P to be easily stored into the cassette 9 without bending the plate P.

(Slide Mechanism and Lifting Mechanism)

Figure 5:
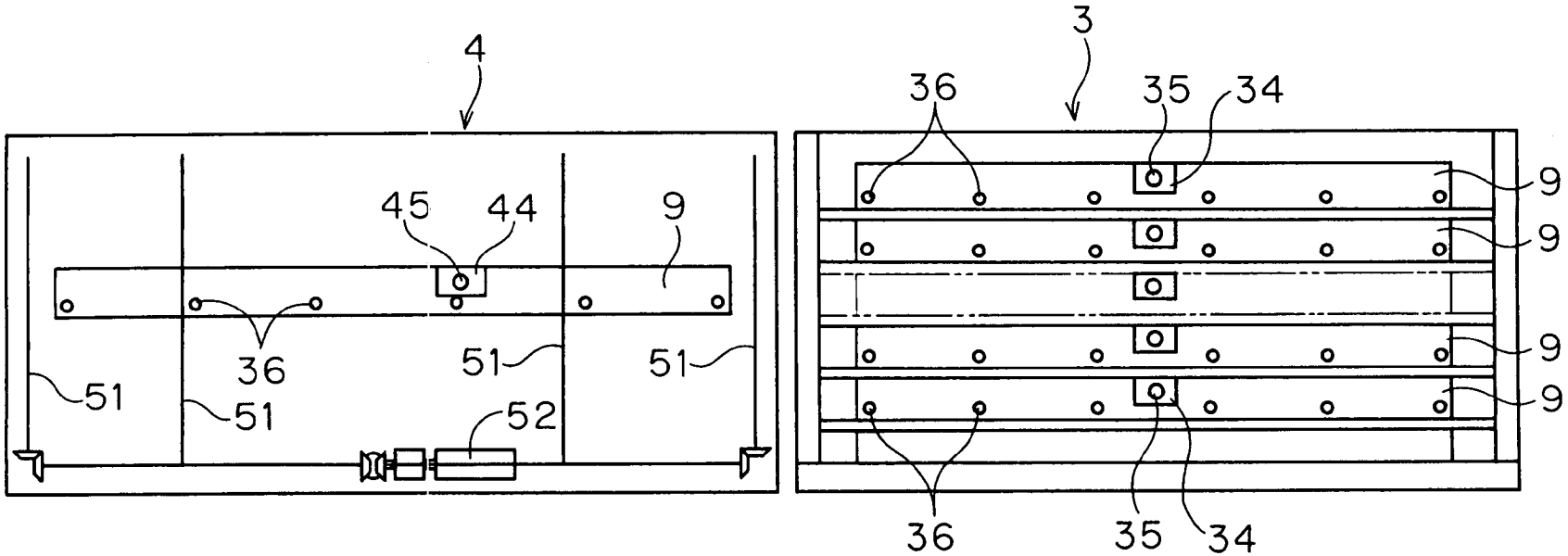
FIG. 5 is a side view showing the constructions of a slide mechanism extending from a multi-cassette part to an autoloader part and a lifting mechanism disposed in the autoloader part.
Figure 6:
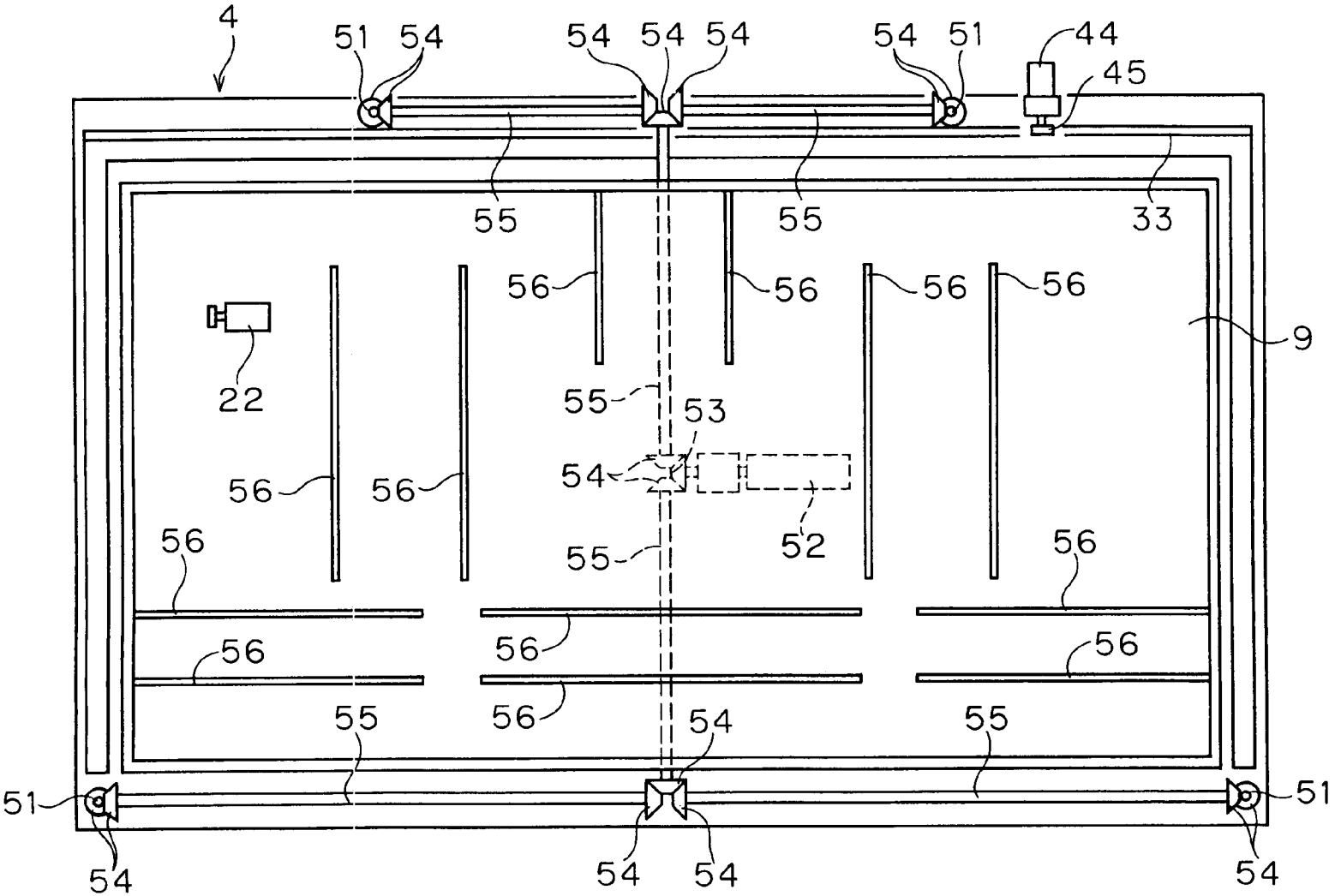
FIG. 6 is a plan view showing the construction of the lifting mechanism disposed in the autoloader part.
Figure 7:
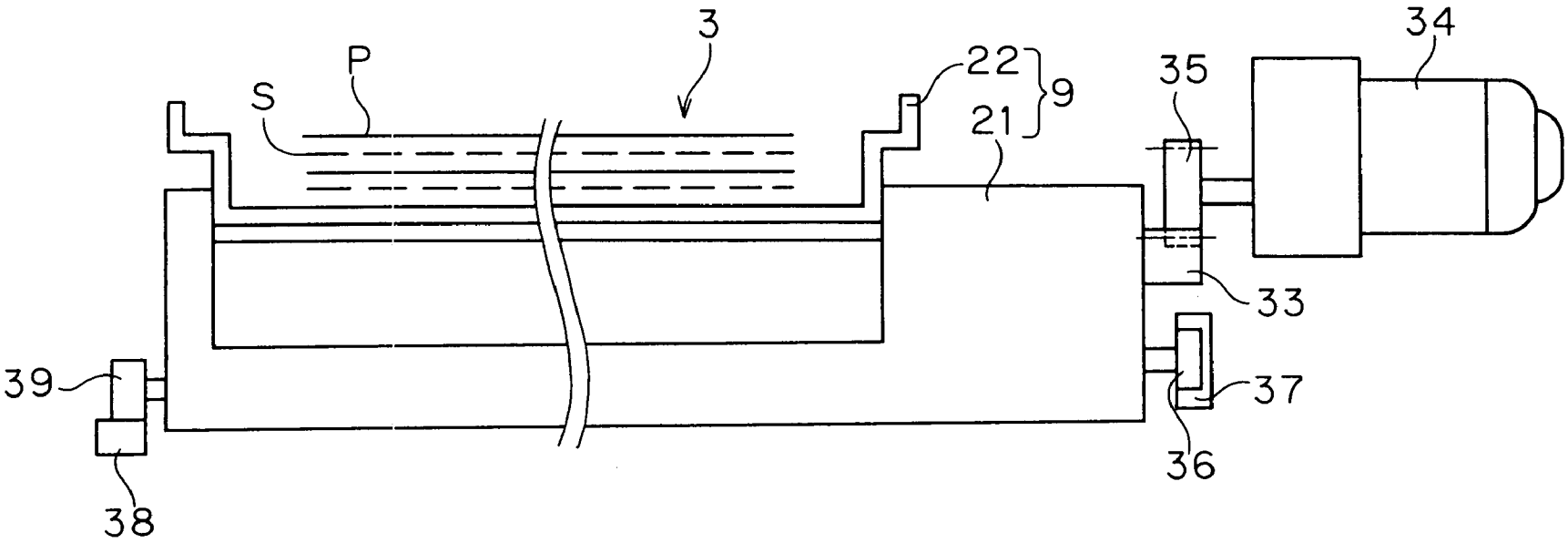
FIGS. 7 and 8 are enlarged views of principal parts showing a relationship between a cassette and the slide mechanism.
Figure 8:
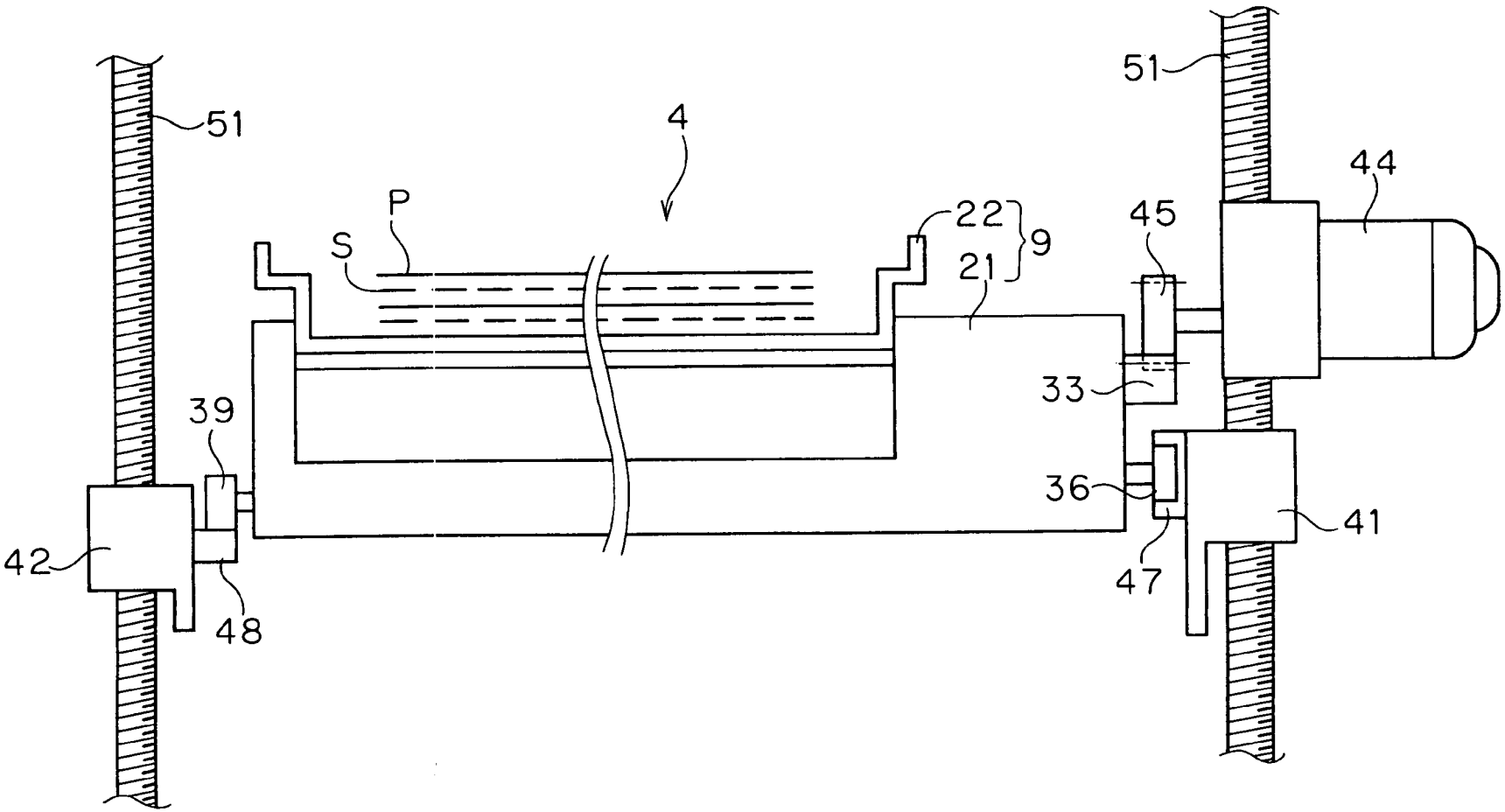

Next, the constructions of the slide mechanism for moving the cassette 9 between the multi-cassette part 3 and the autoloader part 4 and the lifting mechanism for vertically moving the cassette 9 in the autoloader part 4 will be described. FIG. 5 is a side view showing the constructions of the slide mechanism extending between the multi-cassette part 3 and the autoloader part 4 and the lifting mechanism disposed in the autoloader part 4. FIG. 6 is a plan view showing the construction of the lifting mechanism disposed in the autoloader part 4. FIGS. 7 and 8 are enlarged views of principal parts showing the relationship between the cassette 9 and the slide and lifting mechanisms. The relationship between the cassette 9 in the multi-cassette part 3 and the slide mechanism is shown in FIG. 7, and the relationship between the cassette 9 in the autoloader part 4 and the slide and lifting mechanisms is shown in FIG. 8.

The multi-cassette part 3 can store therein the cassettes 9 arranged vertically in five tiers, as shown in FIG. 5. Each of the cassettes 9 has an outer tray 21, and an inner tray 22 disposed inside the outer tray 21, as shown in FIG. 7. A plurality of plates P and a plurality of interleaves S alternately vertically stacked are stored in the inner tray 22. Such a stack of plates P and interleaves S is referred to hereinafter as a plate-interleaf stack. As illustrated in FIG. 7, a rack 33 is attached to one outer side surface of the outer tray 21 of each of the cassettes 9. The rack 33 is in meshing engagement with a pinion 35 driven to rotate by a motor 34 secured to the multi-cassette part 3.

A plurality of rollers 36 for engagement with a guide member 37 provided in the multi-cassette part 3 are provided on the same outer side surface of the outer tray 21 of each cassette 9, as shown in FIG. 7. The guide member 37 is provided in corresponding relation to the location of each of the cassettes 9. In this preferred embodiment, five guide members 37 are provided. A plurality of rollers 39 supported by a support rail 38 provided in the multi-cassette part 3 are provided on the opposite outer side surface of the outer tray 21 of each cassette 9. The support rail 38 is also provided in corresponding relation to the location of each of the cassettes 9. In this preferred embodiment, five support rails 38 are provided.

When the pinion 35 is driven by the motor 34 to rotate, the rack 33 disposed on the outer tray 21 is forced by the pinion 35, whereby the entire cassette 9 is moved in the leftward and rightward directions as seen in FIGS. 5 and 6 (or in the direction perpendicular to the plane of FIG. 7). Thus, each cassette 9 moves horizontally between the multi-cassette part 3 and the autoloader part 4.

Referring to FIG. 8, the autoloader part 4 includes a guide member 47 similar to the guide members 37 of the multi-cassette part 3, and a support rail 48 similar to the support rails 38 of the multi-cassette part 3. A guide member bracket 41 and a support rail bracket 42 are attached to the guide member 47 and the support rail 48, respectively, and are in threaded engagement with respective ball screws 51. The autoloader part 4 further includes a motor 44 similar to the motor 34 of the multi-cassette part 3, and a pinion 45. The motor 44 is coupled through a coupling member not shown to the guide member bracket 41, and is vertically movable with the guide member bracket 41.

As illustrated in FIGS. 5 and 6, a lifting motor 52 provided with a miter gear 53 about its rotary shaft is disposed in a lower central portion of the autoloader part 4. The miter gear 53 is coupled through a plurality of miter gears 54 and a plurality of shafts 55 to the ball screws 51 in threaded engagement with the guide member 47 and the support rail 48. Thus, the set of the guide member 47 and the guide member bracket 41, and the set of the support rail 48 and the support rail bracket 42 are driven by the lifting motor 52 to move vertically.

The cassette 9 having been stored in the middle tier of the multi-cassette part 3 is shown in FIG. 5 as moved into the autoloader part 4. In such a position, the guide members 37 and 47 shown in FIGS. 7 and 8 are arranged in line with each other, and the support rails 38 and 48 are also in line with each other. The pinions 35 in the multi-cassette part 3 and the pinion 45 in the autoloader part 4 are placed on a level with each other and so that a distance therebetween is less than the length of the rack 33 attached to the cassette 9.

With such an arrangement, when the pinion 35 is driven by a corresponding motor 34 in the multi-cassette part 3 to rotate and the pinion 45 is driven by the motor 44 in the autoloader part 4 to rotate, the cassette 9 is initially driven at its rack 33 from the motor 34 through the pinion 35. Thus, the cassette 9 is guided by the guide member 37 and the support rail 38 in the multi-cassette part 3 to move from the multi-cassette part 3 toward the autoloader part 4.

When a leading edge portion of the cassette 9 enters the autoloader part 4, the cassette 9 is then guided by the guide member 47 and the support rail 48. Then, after the rack 33 of the cassette 9 comes into meshing engagement with the pinion 45 in the autoloader part 4 and is driven from the motor 44 through the pinion 45, the rack 33 is disengaged from the pinion 35 in the multi-cassette part 3.

After the disengagement of the rack 33 from the pinion 35, the cassette 9 is also driven from the motor 44 through the pinion 45 in the autoloader part 4 to move to the position shown in FIG. 5. Thereafter, the cassette 9 is driven by the lifting motor 52 to move vertically to the predetermined plate feed position or the cassette take-out position. The plate feed position refers to a position in which the plate P removed out of the cassette 9 is transported toward the image recording part 6, and the cassette take-out position refers to a position in which the cassette 9 is moved into the plate storage part 2. The cassette 9 can hold therein a plurality of horizontally arranged plate-interleaf stacks including plates P of various sizes. To this end, the bottom of the cassette 9 is formed with grooves 56 for mounting therein positioning members 57 (See FIGS. 9A, 9B and 9C) for determining the holding position of the plate-interleaf stacks depending on the sizes of the plates P.

(Cassette 9)

Figure 9A:
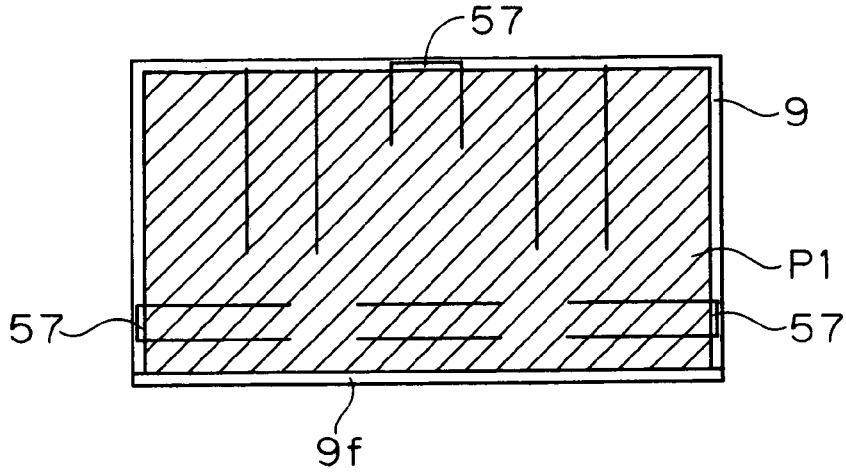
FIGS. 9A, 9B and 9C illustrate plates of various sizes held in the cassette.
Figure 9B:
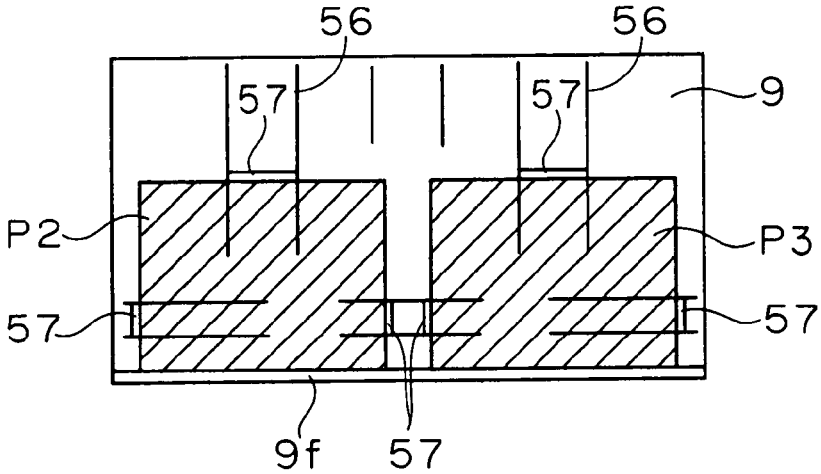
Figure 9C:
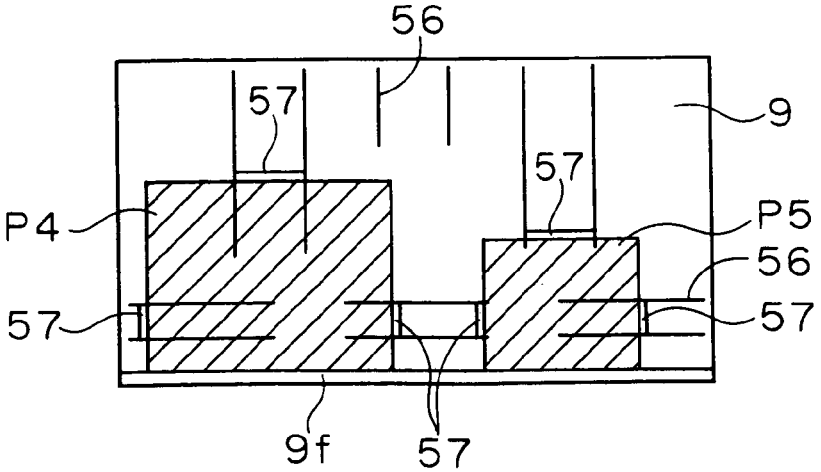

FIGS. 9A, 9B and 9C are top views of the cassette 9 in which plate-interleaf stacks including plates P of various sizes are held. With reference to FIGS. 9A, 9B, 9C and FIG. 10 (to be described later) showing a similar top view, the plate-interleaf stacks will be illustrated using their top plates P (P1 to P5) as a representative for purposes of simplification. FIG. 9A shows a relatively large plate P1 of single size held in the cassette 9. FIG. 9B shows plates P2 and P3 of the same size held in the cassette 9. FIG. 9C shows plates P4 and P5 of different sizes held in the cassette 9. In any one of the cases shown in FIGS. 9A, 9B and 9C, the plate P held in the cassette 9 is positioned in such a manner that one edge of the plate P abuts against one inner wall 9*f* of the cassette 9 and the remaining three edges abut against the positioning members 57 mounted in the grooves 56.

(Plate Transport Mechanism)

Figure 10:
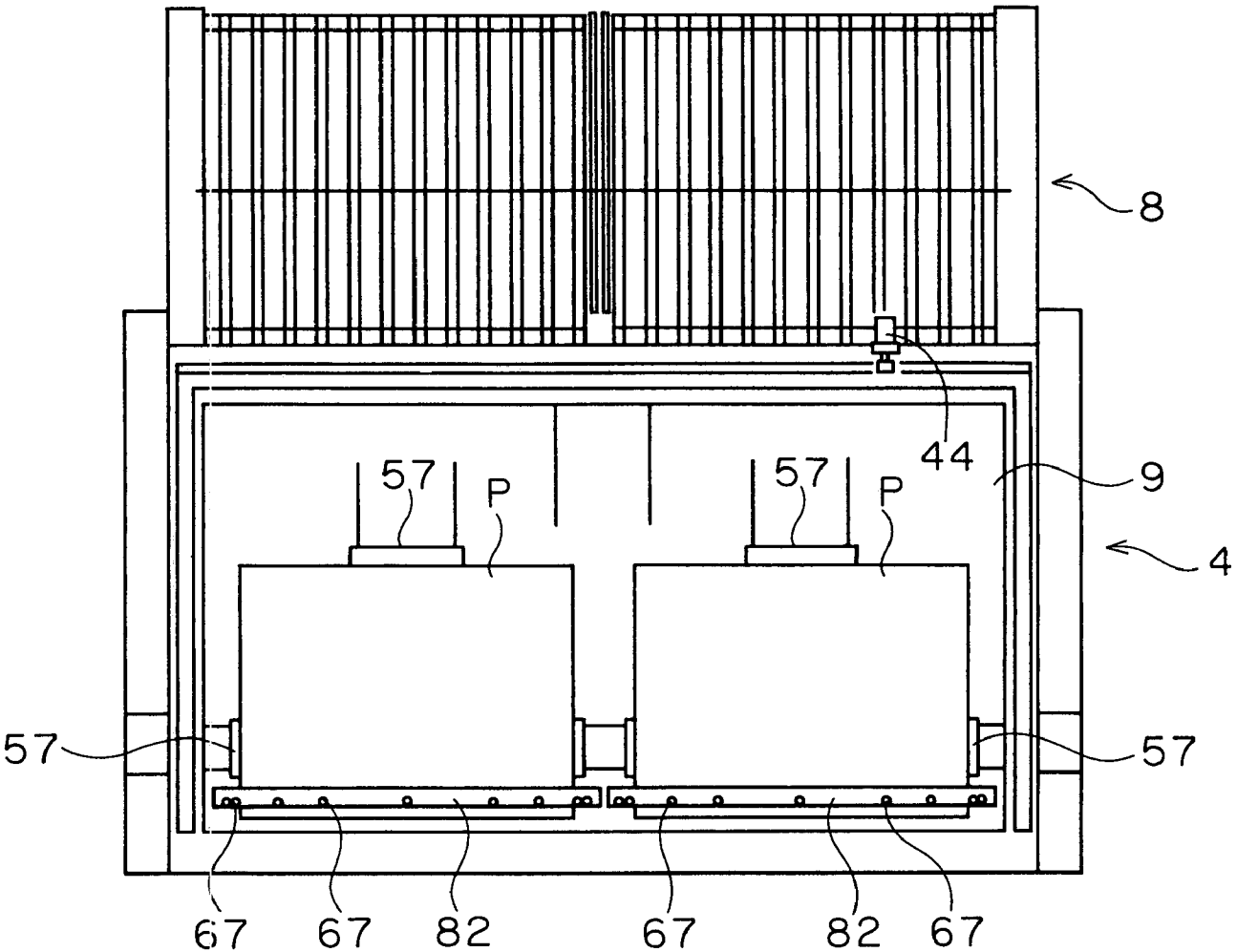
FIG. 10 is a plan view of the autoloader part with a conveyor part for illustration of a plate transport mechanism.
Figure 11:
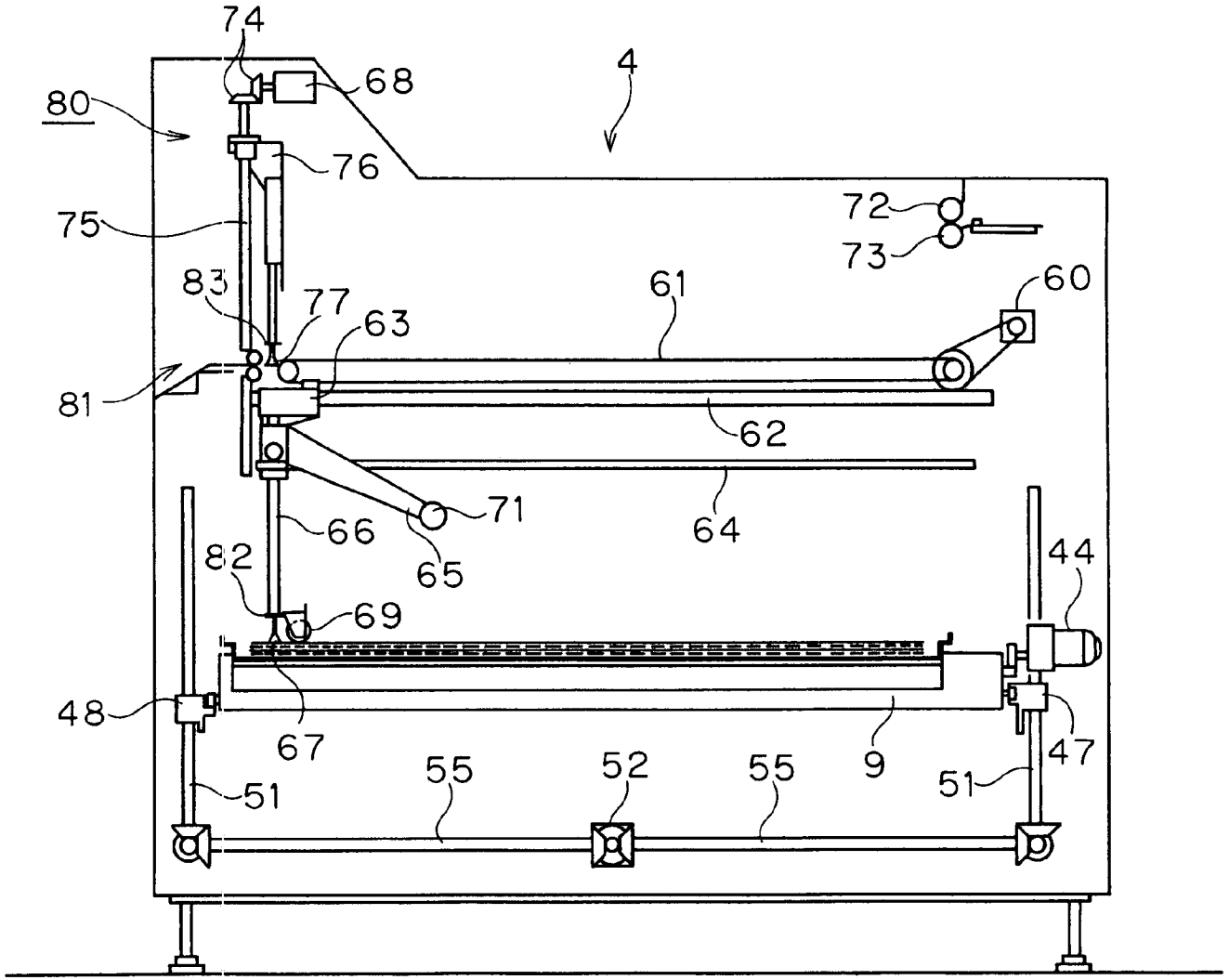
FIG. 11 is a view for illustrating the operations of the plate transport mechanism and the interleaf removal mechanism in the autoloader part.
Figure 15:
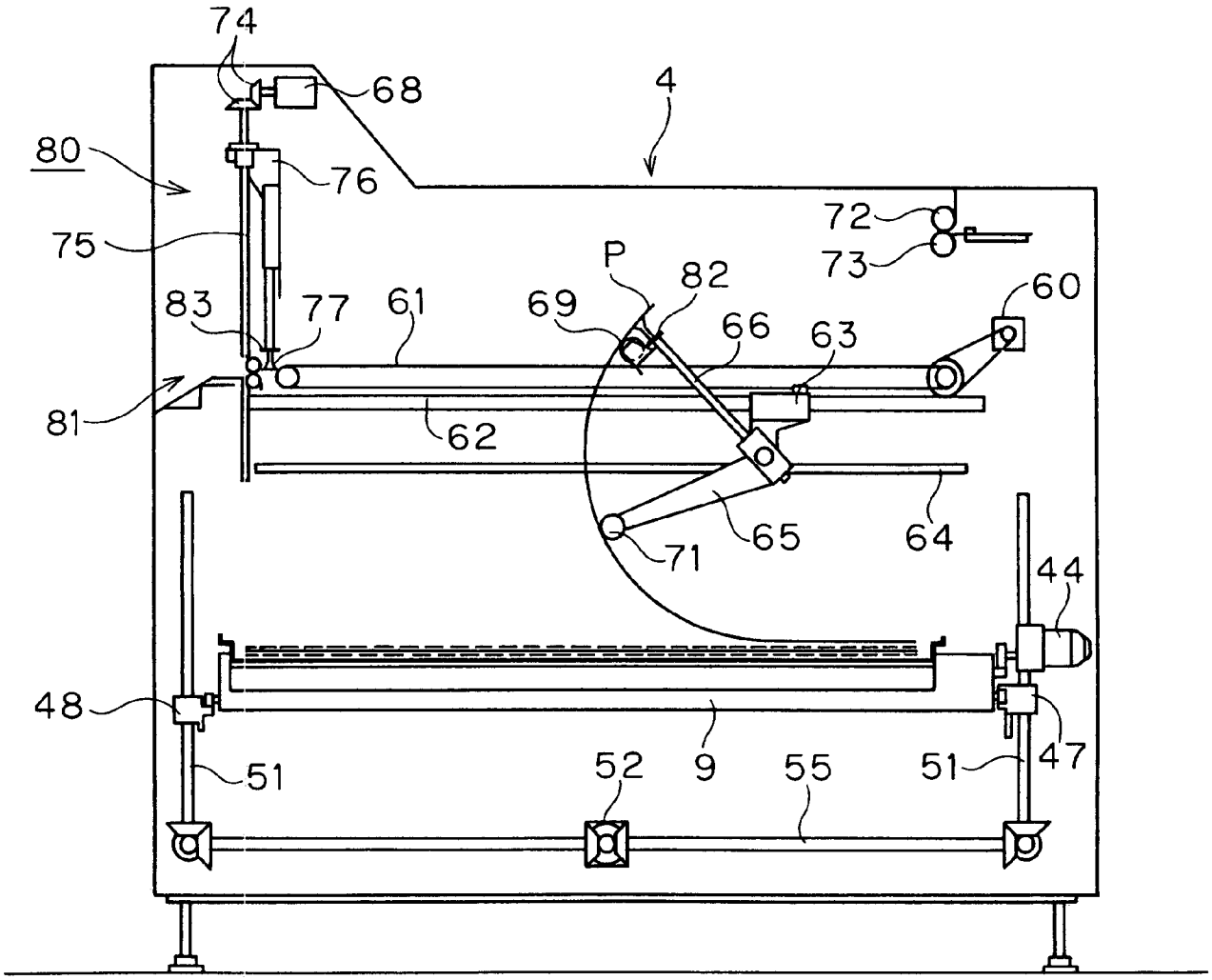
FIGS. 15 and 16 are views for illustrating the operations of the plate transport mechanism and the interleaf removal mechanism in the autoloader part.
Figure 16:
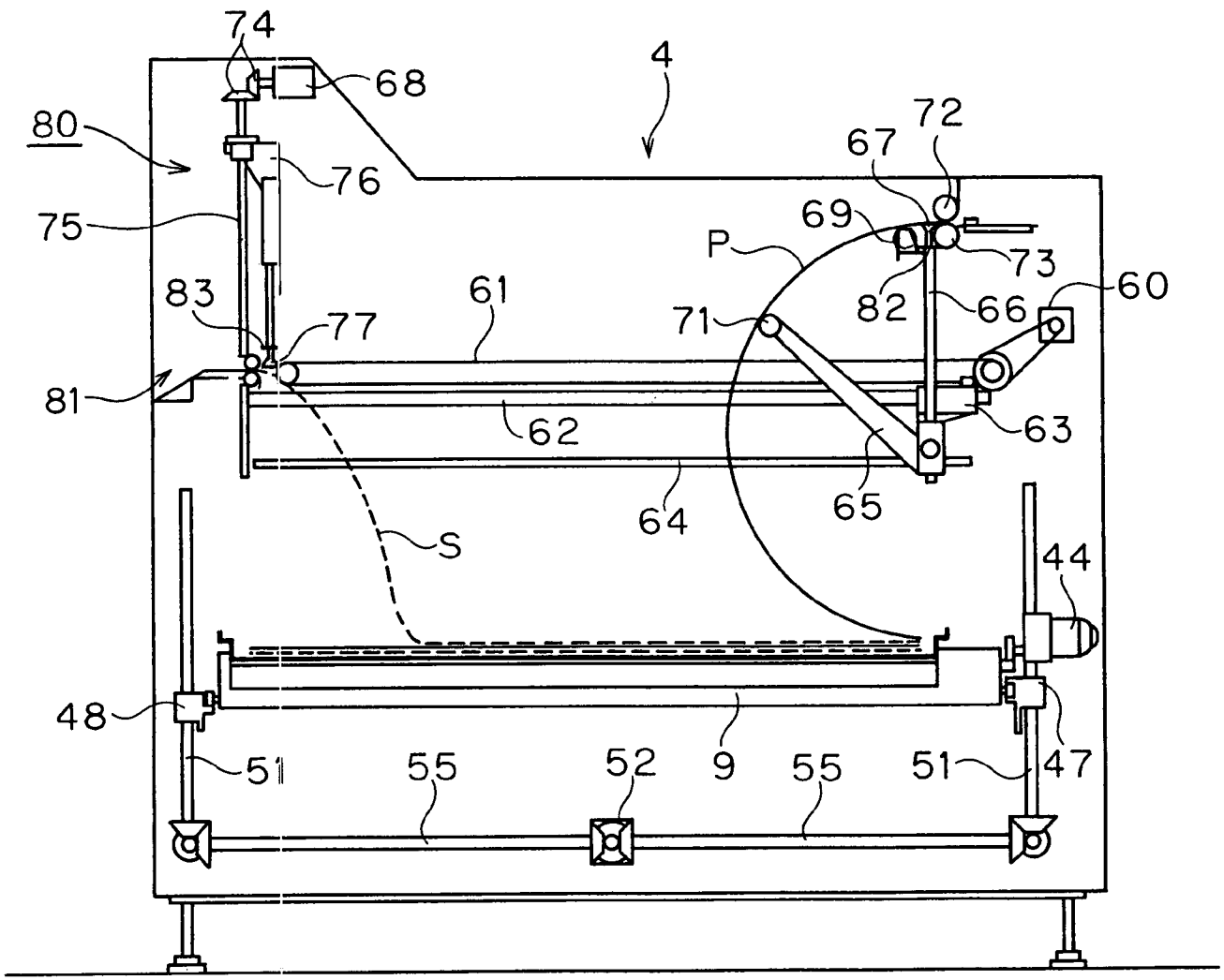

Next, the constructions of a plate transport mechanism for transporting a plate P from the cassette 9 in the plate feed position toward the conveyor part 8, and an interleaf removal mechanism 80 for removing an interleaf S from between plates P in the cassette 9 will be described. FIG. 10 is a plan view showing the autoloader part 4 and the conveyor part 8 for illustration of the plate transport mechanism. FIGS. 11, 15 and 16 are views for illustrating the operations of the plate transport mechanism and the interleaf removal mechanism 80 in the autoloader part 4.

The plate transport mechanism is intended to transport the plate P from the cassette 9 moved to the plate feed position toward the conveyor part 8. The plate transport mechanism principally comprises a motor 60, an endless synchronous belt 61 driven by the motor 60 to run around, and a traveling member 63 attached to the synchronous belt 61 for traveling along a guide rail 62. The traveling member 63 is provided with a pinion not shown for meshing engagement with a rack 64 extending in parallel with the guide rail 62, and an arm 66 is fixed to the pinion. A pair of support plates 82 to be described later are disposed on the forward end of the arm 66, and a plurality of suction pads 67 for holding the plate P under suction are attached to the support plates 82.

A support roller 69 is also disposed on the forward end of the arm 66. The support roller 69 supports a leading edge portion of the plate P from below during the transport of the plate P. An arm 65 is coupled to the arm 66. The arm 65 has a support roller 71 on its forward end. The support roller 71 supports a middle portion of the plate P from below during the transport of the plate P.

As illustrated in FIG. 10, the pair of support plates 82 are arranged in corresponding relation to two plates P held side by side in the cassette 9. The suction pads 67 attached to the support plates 82 are selectively used depending on the size of the plates P to be held under suction. The suction pads 67 may be movable in a direction in which the suction pads 67 are arranged (or leftwardly and rightwardly as seen in FIG. 10) depending on the size of the plates P to be held under suction.

In the plate transport mechanism having such a construction, as the traveling member 63 is driven by the motor 60 to move rightwardly as seen in FIG. 11 from the position shown in FIG. 11, the arm 66 pivots about the axis of the pinion not shown, as shown in FIG. 15 and then in FIG. 16.

Thus, as the traveling member 63 is driven by the motor 60 to move rightwardly while the plate P is held under suction by the suction pads 67 (FIG. 11), the plate P held under suction by the suction pads 67 is flipped over (FIG. 15), and is then held at its leading edge between transport rollers 72 and 73 (FIG. 16). The transport rollers 72 and 73 are a pair of rollers for transporting the plate P toward the conveyor part 8.

(Interleaf Removal Mechanism 80)

Next, the interleaf removal mechanism 80 for removing an interleaf S from between the plates P will be described.

As shown in FIG. 11, the interleaf removal mechanism 80 principally comprises a motor 68, a pair of miter gears 74 for transmitting the driving force of the motor 68, a ball screw 75 driven from the motor 68 through the miter gears 74 to rotate, a lifting member 76 for moving vertically along the ball screw 75, a support 83 attached to the forward end of the lifting member 76, and an interleaf carrying-out part 81.

The interleaf carrying-out part 81 acts to remove an interleaf S taken out of the cassette 9 by suction pads 77 to be described below outwardly from the autoloader part 4.

Figure 12:
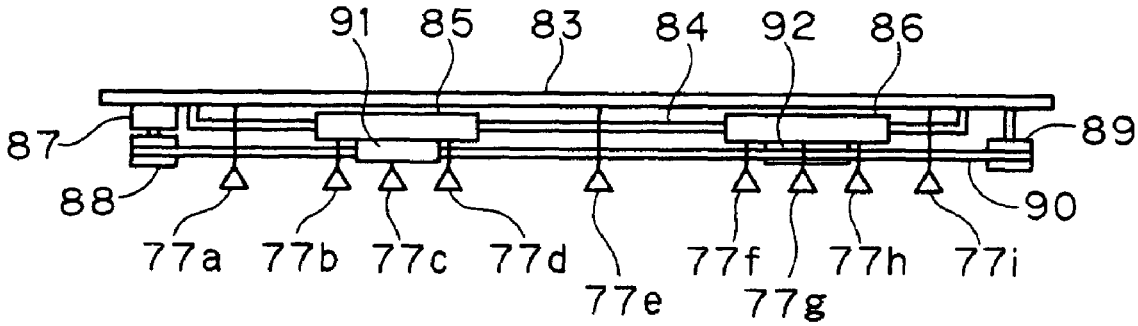
FIG. 12 is a view for illustrating an internal structure of a support in the interleaf removal mechanism.

The support 83 is a member in the form of plate having a bottom surface provided with the suction pads 77 acting as suction cups for holding and fixing the interleaf S under suction. FIG. 12 is a view for illustrating the arrangement of members with respect to the support 83 as viewed in the rightward direction of FIG. 11. As shown in FIG. 12, a guide rail 84 is fixed to the bottom surface of the support 83. Two suction pad holding elements (a first suction pad holding element 85 and a second suction pad holding element 86) are mounted slidably in the rightward and leftward directions as viewed in FIG. 12 to the guide rail 84.

A motor 87 is attached to one end of the bottom surface of the support 83. The motor 87 is used to horizontally move the two suction pad holding elements 85 and 86 toward and away from each other. A pulley 88 is provided integrally with the driving shaft of the motor 87. A pulley 89 is provided on the opposite end of the support 83. A driving belt 90 is looped around and mounted on the pulleys 88 and 89, and is rotatably driven by the motor 87 rotating in normal and reverse directions.

Figure 13:
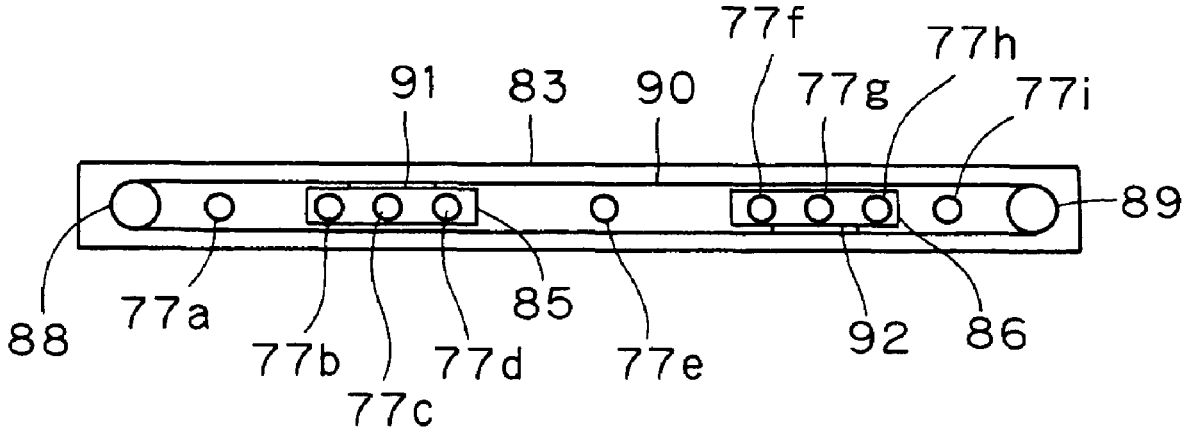
FIG. 13 is a bottom view of the support.

FIG. 13 is a bottom view of the support 83. As illustrated in FIG. 13, the first suction pad holding element 85 is coupled by a coupling member 91 to one of the opposed runs (or an upper run as viewed in FIG. 13) of the driving belt 90. The second suction pad holding element 86 is coupled by a coupling member 92 to the other run (or a lower run as viewed in FIG. 13) of the driving belt 90. Thus, as the motor 87 drives the driving belt 90 to run around in a clockwise direction as viewed in FIG. 13, the first and second suction pad holding elements 85 and 86 are moved toward each other. As the motor 87 drives the driving belt 90 to run around in a counterclockwise direction as viewed in FIG. 13, the first and second suction pad holding elements 85 and 86 are moved away from each other.

Suction pads 77*a* and 77*i* are disposed in opposite end portions of the support 83. A suction pad 77*e* is disposed in a longitudinally middle position of the support 83. These suction pads 77*a*, 77*e* and 77*i* are also referred to as fixed suction pads 77.

Three suction pads 77*b*, 77*c* and 77*d* are fixed on the bottom surface of the first suction pad holding element 85. Similarly, three suction pads 77*f*, 77*g* and 77*h* are fixed on the bottom surface of the second suction pad holding element 86. These six suction pads 77*b*, 77*c*, 77*d*, 77*f*, 77*g* and 77*h* are also referred to as movable suction pads 77.

The suction pads 77*a* to 77*i* are coupled to the same vacuum pump through a suction hose not shown. This allows the suction pads 77*a* to 77*i* to start the vacuum holding operation at the same time. A vacuum degree detection sensor is attached to some mid-portion of the suction hose. Depending on the degree of output from the vacuum degree detection sensor, a discrimination may be made among a plurality of states: a state in which nothing is vacuum-held by the suction pads 77; a state in which only an interleaf S is vacuum-held; a state in which only a plate P is vacuum-held; a state in which a plate P is attached to the back surface of an interleaf S; and a state in which a plurality of interleaves S are vacuum-held.

A switching valve or the like is mounted to some mid-portion of the suction hose to allow individual control of the vacuum holding operations of the suction pads 77*a* to 77*i*.

As discussed with reference to FIGS. 9A through 9C, the cassette 9 can hold therein a relatively large plate-interleaf stack of single size or two plate-interleaf stacks of the same size or of different sizes. The interleaf removal mechanism 80 in the apparatus according to the present invention, which includes the two sets of three movable suction pads 77*b*, 77*c* and 77*d*, and 77*f*, 77*g* and 77*h* movable in a direction perpendicular to the feed direction of the plate P, can perform a vacuum holding operation which quickly responds to changes, if any, in types and sizes of the plates P.

For instance, if a single plate-interleaf stack including plates P of a relatively small size is held in the cassette 9, the motor 87 is rotated in the clockwise direction as viewed in FIG. 13 to move the first and second suction pad holding elements 85 and 86 toward the middle of the support 83 for adaptation to the size of the plates P. On the other hand, if plates P of a relatively large size are held in the cassette 9 as shown in FIG. 9A, the first and second suction pad holding elements 85 and 86 are moved toward the opposite ends of the support 83.

If two plate-interleaf stacks are held side by side in the cassette 9 as shown in FIG. 9B or 9C, the first and second suction pad holding elements 85 and 86 are moved so that the suction pads 77 in the middle of the respective suction pad holding elements 85 and 86, i.e. the suction pads 77*c* and 77*g*, come into the middle of the plates P of the respective stacks.

As shown in FIG. 11, when the suction pads 67 in the plate transport mechanism start holding the plate P under suction, the lifting member 76 in the interleaf removal mechanism 80 is on standby in a raised position within its vertically movable range. Thereafter, the lifting member 76 starts moving downwardly when the leading edge portion of the plate P held under suction by the suction pads 67 is transported toward the pair of transport rollers 72 and 73.

(Interleaf Carrying-Out Part 81)

Figure 18:
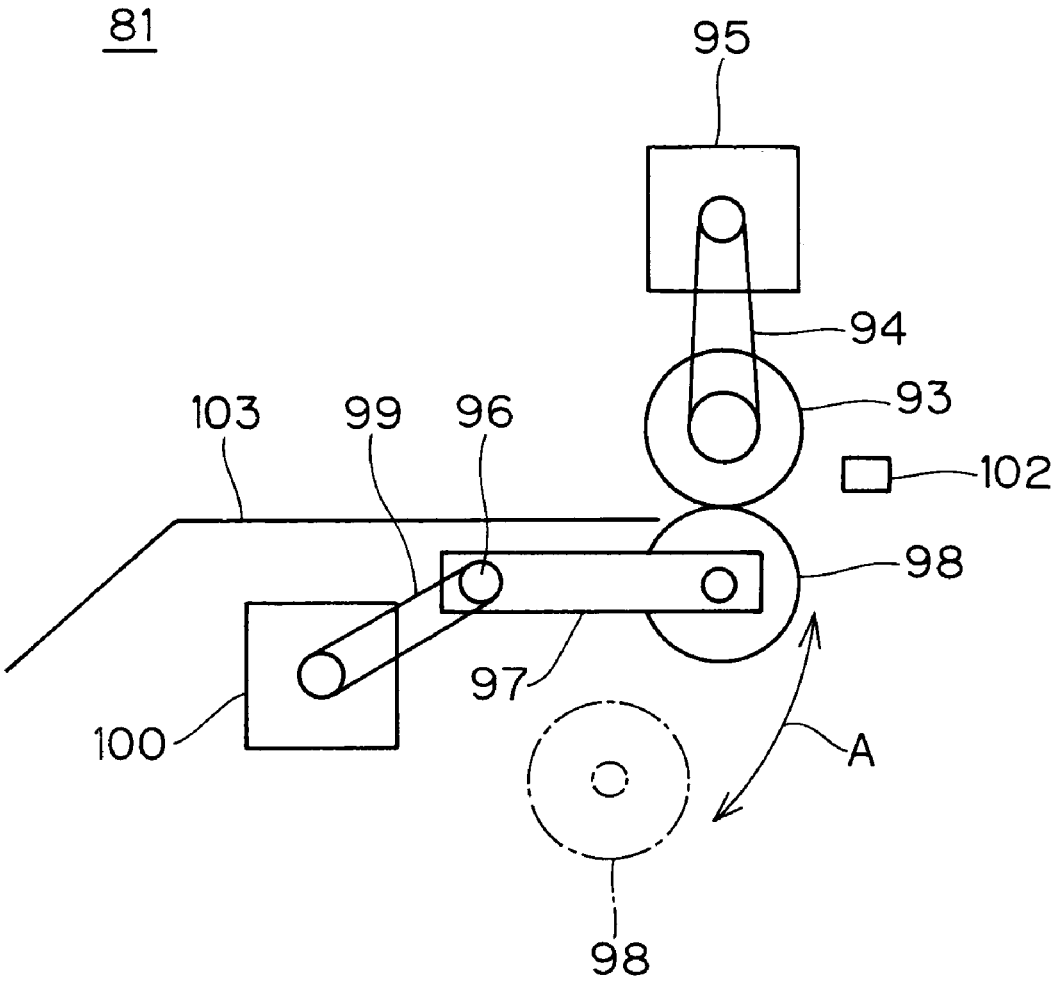
FIG. 18 is a side view of an interleaf carrying-out part in the interleaf removal mechanism.

FIG. 18 is a side view on an enlarged scale showing the interleaf carrying-out part 81. As shown in FIG. 18, the interleaf carrying-out part 81 principally includes a first roller 93, a discharge motor 95, an arm 97, a second roller 98, a nip motor 100, a sensor 102, and a guide plate 103. The discharge motor 95 rotates the first roller 93 through a drive belt 94. The nip motor 100 pivots the arm 97 through a drive belt 99. The arm 97 is pivoted about a fulcrum 96 in directions indicated by a double-headed arrow A. The second roller 98 is disposed on the front end of the arm 97. The second roller 98 and the first roller 93 constitute a pair of nip rollers which rotate to transport an interleaf S. The guide plate 103 guides the interleaf S being transported toward an interleaf collection box 10 (See FIG. 2) outside the autoloader part 4. The sensor 102 optically detects the interleaf S in a position close to the first roller 93. The rotation axes of the first and second rollers 93 and 98 are coincident with a direction in which the plurality of suction pads 77*a* to 77*i* are arranged and also coincident with a direction in which the first and second suction pad-holding elements 85 and 86 move.

At an early stage of the removal of the interleaf S, the second roller 98 is in a retracted position (a position remote from the first roller 93 and non-contactable with the first roller 93) indicated by dash-dot lines in FIG. 18. When the leading edge portion of the interleaf S is lifted by the suction pads 77 up to a position opposed to the first roller 93, the arm 97 pivots about the fulcrum 96 to move the second roller 98 until the second roller 98 reaches a nipping position (a position close to the first roller 93 and contactable with the first roller 93) indicated by solid lines in FIG. 18. This causes the leading edge portion of the interleaf S to be pinched between the first roller 93 and the second roller 98. As the discharge motor 95 rotates in this condition, the first roller 93 rotates and the second roller 98 is driven to rotate, whereby the interleaf S is transported toward the guide plate 103. In this manner, the pair of nip rollers constructed by the first roller 93 and the second roller 98 are capable of switching between an open state and a nipping state.

Figure 14:
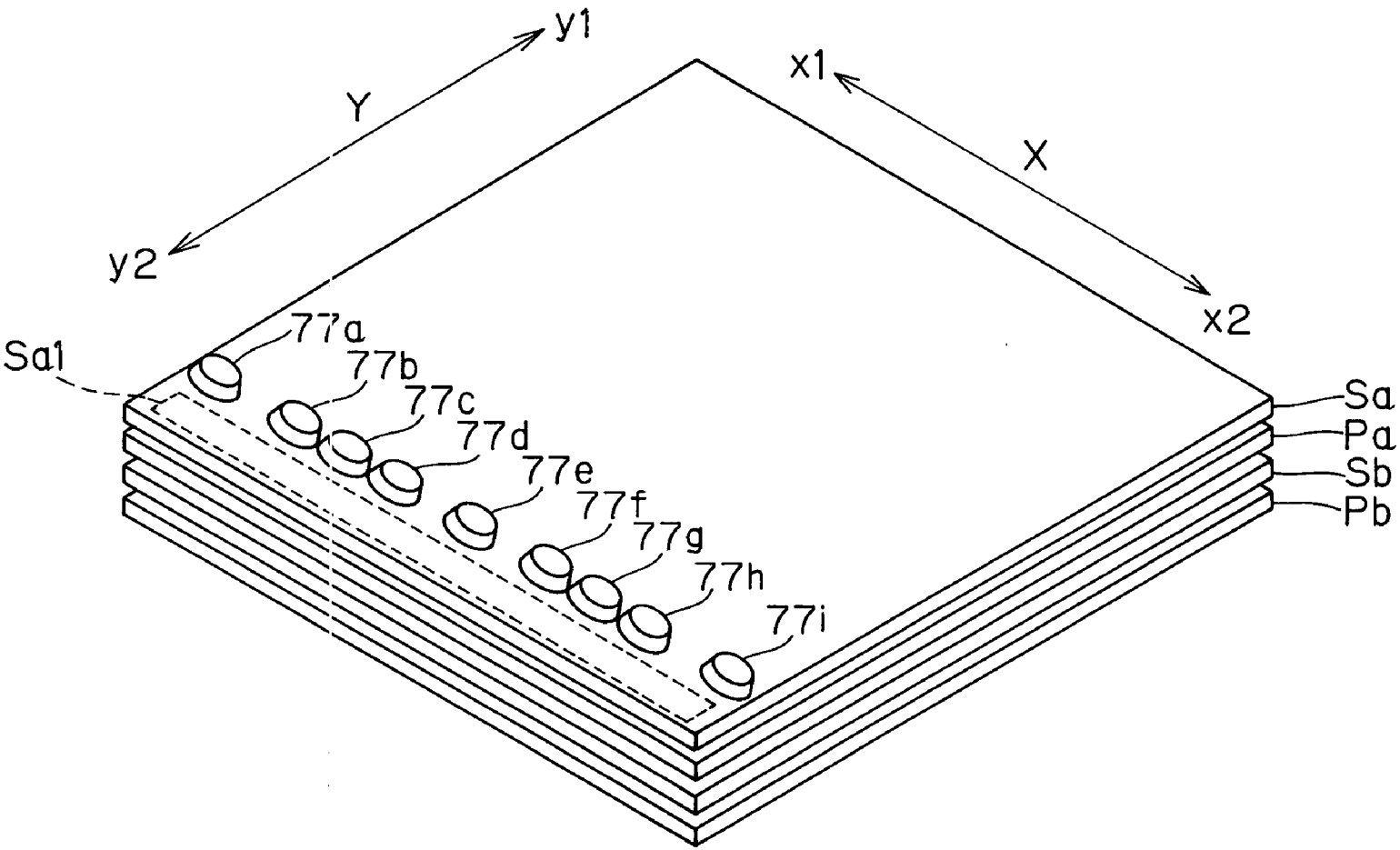
FIG. 14 is a view for illustrating plates and interleaves stacked in the cassette.

FIG. 14 is a perspective view schematically showing a plate-interleaf stack stored in a cassette 9 for illustration of the effects of the present invention. The X direction in FIG. 14 is the direction in which the plurality of suction pads 77*a* to 77*i* are arranged, and the Y direction is a direction orthogonal to the X direction. As shown in FIG. 14, an interleaf Sa is at the top of the stack, and a three-layered stack composed of a plate Pa, an interleaf Sb and a plate Pb is stored in the order named under the interleaf Sa. A rectangular region indicated by chain-dotted lines in FIG. 14 is a leading edge portion Sa1 of the interleaf Sa to be held between the first roller 93 and the second roller 98 provided in the interleaf carrying-out part 81 and constituting the pair of nip rollers. Although shown as spaced apart from each other in FIGS. 14, 17A and 17B for purposes of illustration, the interleaves S (Sa, Sb) and the plates P (Pa, Pb) are actually in contact with each other.

Next, the operation of removing the interleaves one by one from the plate-interface stack in the cassette 9 by means of the interleaf removal mechanism 80 will be described. FIGS. 17A to 17D are side views of principal parts of the interleaf removal mechanism 80 as viewed in the rightward direction of FIG. 11 (in the direction of the arrow y1 of FIG. 14). The plate-interleaf stack are shown as appropriate in FIGS. 17A to 17D.

Figure 17A:
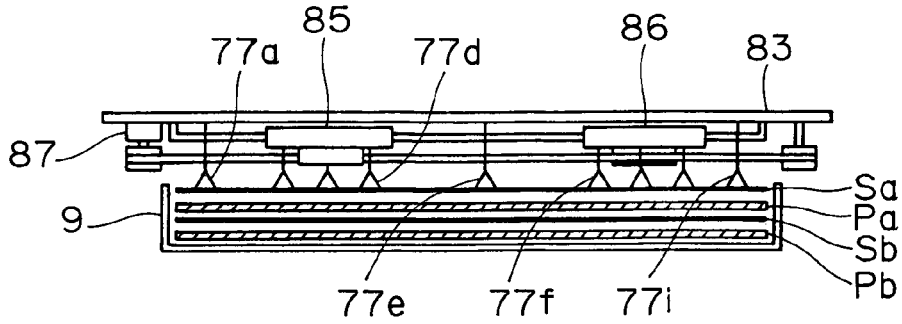
FIGS. 17A, 17B, 17C and 17D are views for illustrating the operation of the interleaf removal mechanism.

FIG. 17A shows that the top interleaf Sa in the cassette 9 is in a normal, wrinkle-free condition. With the interleaf Sa in such a condition, the first suction pad holding element 85 and the second suction pad holding element 86 move horizontally in accordance with a dimension of the interleaf Sa in the X direction. Next, the suction pads 77*a* to 77*i* are selectively activated also in accordance with the dimension of the interleaf Sa in the X direction. Thus, the interleaf Sa is held under suction by the suction pads 77. The support 83 is lifted until the leading edge of the interleaf Sa held under suction reaches a vertical position opposed to the first roller 93 (see FIG. 18) of the interleaf carrying-out part 81. During the lifting operation, the positions of the first suction pad holding element 85 and the second suction pad holding element 86 with respect to the X direction remain the same. Because there are no wrinkles in the interleaf Sa as described above, the leading edge portion Sa1 of the interleaf Sa is properly held between the first roller 93 and the second roller 98 when the second roller 98 pivots about the fulcrum 96.

Figure 17B:
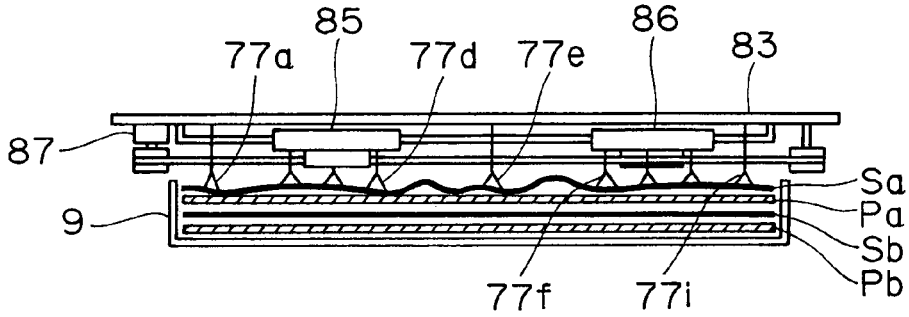

There are, however, cases where the top interleaf Sa in the cassette 9 is wrinkled, as shown in FIG. 17B. Especially large wrinkles are shown in FIG. 17B as formed between the suction pads 77*d* and 77*e* and between the suction pads 77*e* and 77*f*. If the interleaf Sa in such a condition is held under suction by the suction pads 77*a* to 77*i* and the support 83 is lifted, there is a danger that a paper jam occurs when the interleaf Sa is held between the first roller 93 and the second roller 98.

To prevent this, a process to be described below is performed when the interleaf Sa is wrinkled. The arrangement of the suction pads 77*a* to 77*i* depending on the size of the interleaf Sa, that is, the arrangement of the suction pads 77*a* to 77*i* in spaced apart relation suitable for holding the interleaves S stored in the cassette 9 is referred to hereinafter as an original arrangement of the suction pads 77*a* to 77*i*. For the interleaves S shown in FIGS. 17A to 17D, the arrangement of the suction pads 77 shown in FIG. 17A is the original arrangement of the suction pads.

First, the support 83 is moved downwardly by the operation of downwardly moving the lifting member 76 from a standby position at the upper end of the raising/lowering stroke of the ball screw 75 until the suction pads 77*a* to 77*i* come into contact with the interleaf Sa (FIG. 17B). Upon contacting the interleaf Sa, the suction pads 77*a* to 77*i* are deformed as appropriate depending on the irregularities of the surface of the interleaf Sa. Next, at least one of the suction pads 77 opposed to the interleaf Sa is selected, and suction starts to cause the interleaf Sa to attach to the suction pads 77 under suction.

Figure 17C:
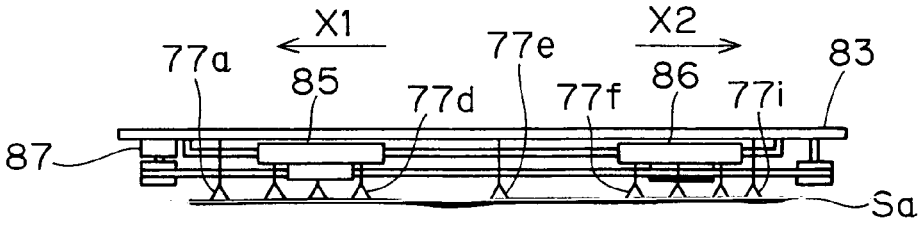
Figure 17D:
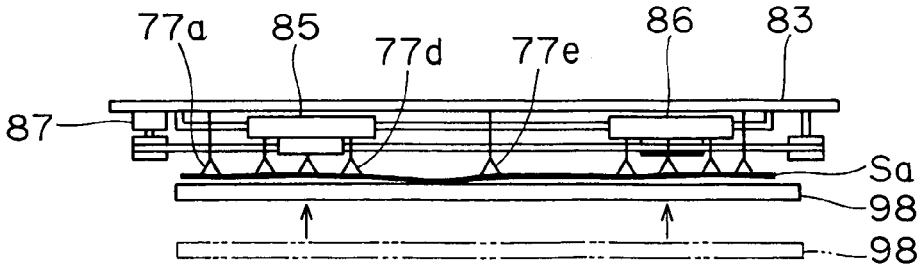

Next, the support 83 is moved upwardly by the operation of upwardly moving the lifting member 76 until the leading edge portion Sa1 of the interleaf Sa reaches a position immediately under the first roller 93. Next, the first suction pad holding element 85 moves in a direction x1 and the second suction pad holding element 86 moves in a direction x2. In other words, the first and second suction pad holding elements 85 and 86 move horizontally away from each other. This causes a portion of the interleaf Sa held under suction by the suction pads 77*b*, 77*c*, 77*d* and a portion of the interleaf Sa held under suction by the suction pads 77*f*, 77*g*, 77*h* to move horizontally away from each other, thereby stretching the interleaf Sa, as shown in FIG. 17C. In other words, the wrinkles in the interleaf Sa are removed. Thus, the leading edge portion Sa1 of the interleaf Sa is stretched in a substantially horizontal position, and becomes substantially parallel to the rotation axes of the first roller 93 and the second roller 98.

Next, the nip motor 100 in the interleaf carrying-out part 81 rotates to pivot the arm 97 about the fulcrum 96. This moves the second roller 98 from the retracted position indicated by dash-double-dot lines in FIG. 17D to the nipping position indicated by solid lines. Then, the leading edge portion Sa1 of the interleaf Sa is held between the second roller 98 and the first roller 93 (although the first roller 93 opposed to the second roller 98 is not shown in FIG. 17D).

Because the wrinkles in the interleaf Sa occurring in the cassette 9 are removed by the stretch of the interleaf Sa caused by the horizontal movement of the suction pads 77 shown in FIG. 17C, the leading edge portion Sa1 is properly held between the second roller 98 and the first roller 93.

Thereafter, the holding of the interleaf Sa under suction by the plurality of suction pads 77 is released by stopping the suction of the suction pads 77*a* to 77*i*. Subsequently, the suction pads 77 are completely separated from the interleaf Sa by upwardly moving the lifting member 76 toward the standby position at the upper end of the raising/lowering stroke of the ball screw 75. Next, as the discharge motor 95 rotates the first roller 93, the interleaf Sa held between the first roller 93 and the second roller 98 is transported toward the guide plate 103. The sensor 102 detects a paper jam of the interleaf Sa being transported. If a paper jam is detected, an appropriate error handling process such as the process of stopping the interleaf removal operation is carried out.

Concurrently with the above-mentioned transport of the interleaf Sa, the first suction pad holding element 85 and the second suction pad holding element 86 move horizontally so that the plurality of suction pads 77 are placed in the original arrangement depending on the size of the interleaf Sb to be removed next.

In the above-mentioned case, a direction in which the suction pads 77*b*, 77*c*, 77*d* and the suction pads 77*f*, 77*g*, 77*h* move is substantially coincident with the direction of the rotation axes of the first and second rollers 93 and 98. That is, a direction in which the wrinkles in the interleaf Sa are intended to be removed is coincident with the direction of the rotation axes of the pair of nip rollers (the first roller 93 and the second roller 98). This effectively prevents a paper jam in the nip rollers.

In the above-mentioned preferred embodiment, the operation of removing the wrinkles in the interleaf Sa is performed after the interleaf Sa is taken out of the cassette 9. However, the operation of removing the wrinkles may be performed while the interleaf Sa is placed in the cassette 9. Specifically, immediately after the suction pads 77 hold the interleaf Sa under suction as shown in FIG. 17B, the wrinkles in the interleaf Sa may be removed by moving the first and second suction pad holding elements 85 and 86 horizontally away from each other. In this condition, however, the interleaf Sa sometimes clings to the plate Pa underlying the interleaf Sa because of static electricity and the like. There is, therefore, a danger that the execution of the operation of removing the wrinkles in this condition causes the interleaf Sa to separate from the suction pads 77.

In the above-mentioned preferred embodiment, the operation of removing the wrinkles in the interleaf Sa is performed after the support 83 is moved sufficiently upwardly. Thus, if the plate Pa clings to the back surface of the interleaf Sa, it is considered that the plate Pa separates from and falls off the interleaf Sa by its own weight during the upward movement of the support 83. This leads to the operation of removing the wrinkles in the interleaf Sa without the plate Pa clinging to the back surface of the interleaf Sa, in the above-mentioned preferred embodiment. This reduces the danger that the interleaf Sa separates from the suction pads 77 as the operation of removing the wrinkles is performed.

From the viewpoint of operating efficiency, it is desirable that the operation of nipping the interleaf Sa between the first roller 93 and the second roller 98 is carried out immediately after the operation of removing the wrinkles in the interleaf Sa.

Whether to perform the operation of removing the wrinkles or not is judged depending on whether there are wrinkles in the interleaf Sa or not, in the above-mentioned preferred embodiment. However, the operation of removing the wrinkles may always be performed independently of whether there are wrinkles in the interleaf Sa or not.

If the interleaf Sa is not rigid, the leading edge portion Sa1 of the interleaf Sa strongly tends to droop. To avoid this, the second roller 98, which is one of the pair of nip rollers, is adapted to hold the leading edge portion Sa1 of the interleaf Sa with the first roller 93 by the pivotal movement of the arm 97. If the interleaf Sa is rigid, the second roller 98 need not necessarily be moved freely by the pivotal movement of the arm 97. In other words, the second roller 98 may be fixed.

While the invention has been described in detail, the foregoing description is in all aspects illustrative and not restrictive. It is understood that numerous other modifications and variations can be devised without departing from the scope of the invention.

What is claimed is:

1. An interleaf removal apparatus for removing an interleaf from a stack of alternating plates and interleaves, said interleaf removal apparatus comprising:

(a) a plurality of suction cups for holding and fixing an interleaf under suction;

(b) a support for supporting said plurality of suction cups;

(c) a lifting element for vertically moving said plurality of suction cups together with said support with respect to said stack;

(d) a suction element for causing said plurality of suction cups to exert suction;

(e) a suction cup moving element for moving at least one of said plurality of suction cups toward and away from the remainder of said plurality of suction cups; and (f) a rotatable holding element including a pair of rollers capable of rotating while holding an interleaf therebetween, wherein said lifting element vertically moves said support to locate an interleaf held under suction by said plurality of suction cups in a nearby position close to said rotatable holding element, wherein said suction cup moving element is capable of moving at least one of said plurality of suction cups when said interleaf held under suction is in said nearby position, and wherein said rotatable holding element rotates while holding said interleaf held under suction in a stretched condition in said nearby position to remove said interleaf held under suction outwardly, and said suction element releases the suction when said interleaf held under suction is held by said rotatable holding element.

2. The interleaf removal apparatus according to claim 1, wherein said rotatable holding element is capable of switching between an open state and a nipping state, and said rotatable holding element is switched from said open state to said nipping state to hold said interleaf held under suction when said interleaf held under suction is in said stretched condition in said nearby position.

3. The interleaf removal apparatus according to claim 2, wherein a direction in which said plurality of suction cups move is coincident with a direction of a rotation axis of said rotatable holding element.

4. The interleaf removal apparatus according to claim 2, wherein said plurality of suction cups hold said interleaf under suction in a position remote from a leading edge portion of said interleaf, and said rotatable holding element further includes an arm for holding one of said pair of rollers at its front end, and a motor for pivoting said arm to thereby move said one of said pair of rollers from said open state to said nipping state while said leading edge portion of said interleaf held under suction is pinched between said pair of rollers.

5. A plate feed apparatus for feeding a plate to a recording apparatus for forming an image on said plate, said plate feed apparatus comprising:

(a) a storage part for storing therein a stack of alternating plates and interleaves; and (b) an interleaf removal mechanism for removing an interleaf from said stack, said interleaf removal mechanism including:

(b-1) a plurality of suction cups for holding and fixing an interleaf under suction;

(b-2) a support for supporting said plurality of suction cups;

(b-3) a lifting element for vertically moving said plurality of suction cups together with said support with respect to said stack;

(b-4) a suction element for causing said plurality of suction cups to exert suction;

(b-5) a suction cup moving element for moving at least one of said plurality of suction cups toward and away from the remainder of said plurality of suction cups; and (b-6) a rotatable holding element including a pair of rollers capable of rotating while holding an interleaf therebetween, wherein said lifting element vertically moves said support to locate an interleaf held under suction by said plurality of suction cups in a nearby position close to said rotatable holding element, wherein said suction cup moving element is capable of moving at least one of said plurality of suction cups when said interleaf held under suction is in said nearby position, and wherein said rotatable holding element rotates while holding said interleaf held under suction in a stretched condition in said nearby position to remove said interleaf held under suction outwardly, and said suction element releases the suction when said interleaf held under suction is held by said rotatable holding element.

6. The plate feed apparatus according to claim 5, wherein said rotatable holding element is capable of switching between an open state and a nipping state, and said rotatable holding element is switched from said open state to said nipping state to hold said interleaf held under suction when said interleaf held under suction is in said stretched condition in said nearby position.

7. The plate feed apparatus according to claim 6, wherein a direction in which said plurality of suction cups move is coincident with a direction of a rotation axis of said rotatable holding element.

8. The plate feed apparatus according to claim 6, wherein said plurality of suction cups hold said interleaf under suction in a position remote from a leading edge portion of said interleaf, and said rotatable holding element further includes an arm for holding one of said pair of rollers at its front end, and a motor for pivoting said arm to thereby move said one of said pair of rollers from said open state to said nipping state while said leading edge portion of said interleaf held under suction is pinched between said pair of rollers.

9. An image recording system comprising:

an image recording apparatus for recording an image on a plate; and a plate feed apparatus for feeding said plate to said image recording apparatus, said plate feed apparatus including:

(a) a storage part for storing therein a stack of alternating plates and interleaves; and (b) an interleaf removal mechanism for removing an interleaf from said stack, said interleaf removal mechanism including:

(b-1) a plurality of suction cups for holding and fixing an interleaf under suction;

(b-2) a support for supporting said plurality of suction cups;

(b-3) a lifting element for vertically moving said plurality of suction cups together with said support with respect to said stack;

(b-4) a suction element for causing said plurality of suction cups to exert suction;

(b-5) a suction cup moving element for moving at least one of said plurality of suction cups toward and away from the remainder of said plurality of suction cups; and (b-6) a rotatable holding element including a pair of rollers capable of rotating while holding an interleaf therebetween, wherein said lifting element vertically moves said support to locate an interleaf held under suction by said plurality of suction cups in a nearby position close to said rotatable holding element, wherein said suction cup moving element is capable of moving at least one of said plurality of suction cups when said interleaf held under suction is in said nearby position, and wherein said rotatable holding element rotates while holding said interleaf held under suction in a stretched condition in said nearby position to remove said interleaf held under suction outwardly, and said suction element releases the suction when said interleaf held under suction is held by said rotatable holding element.

10. The image recording system according to claim 9, wherein said rotatable holding element is capable of switching between an open state and a nipping state, and said rotatable holding element is switched from said open state to said nipping state to hold said interleaf held under suction when said interleaf held under suction is in said stretched condition in said nearby position.

11. The image recording system according to claim 10, wherein a direction in which said plurality of suction cups move is coincident with a direction of a rotation axis of said rotatable holding element.

12. The image recording system according to claim 10, wherein said plurality of suction cups hold said interleaf under suction in a position remote from a leading edge portion of said interleaf, and said rotatable holding element further includes an arm for holding one of said pair of rollers at its front end, and a motor for pivoting said arm to thereby move said one of said pair of rollers from said open state to said nipping state while said leading edge portion of said interleaf held under suction is pinched between said pair of rollers.

* * * * *